US007280084B2

(12) United States Patent
Herbert et al.

(10) Patent No.: US 7,280,084 B2
(45) Date of Patent: Oct. 9, 2007

(54) ANTENNA SYSTEM FOR GENERATING AND UTILIZING SEVERAL SMALL BEAMS FROM SEVERAL WIDE-BEAM ANTENNAS

(75) Inventors: Germar Jochen Herbert, Nuremberg (DE); Martin Willem Klomp, Spalt (DE)

(73) Assignee: Koninklijke KPN N.V., Groningen (NL)

( * ) Notice: Subject to any disclaimer, the term of this patent is extended or adjusted under 35 U.S.C. 154(b) by 186 days.

(21) Appl. No.: 10/893,762

(22) Filed: Jul. 16, 2004

(65) Prior Publication Data

US 2005/0037813 A1 Feb. 17, 2005

Related U.S. Application Data

(60) Provisional application No. 60/487,631, filed on Jul. 16, 2003.

(51) Int. Cl.
*H01Q 1/50* (2006.01)

(52) U.S. Cl. ..... 343/850; 343/853

(58) Field of Classification Search ..... 343/850, 343/853, 871

See application file for complete search history.

(56) References Cited

U.S. PATENT DOCUMENTS

| | | | | |
|---|---|---|---|---|
| 4,499,471 | A * | 2/1985 | Luh | 342/373 |
| 4,799,065 | A * | 1/1989 | Thompson | 343/779 |
| 6,252,560 | B1 * | 6/2001 | Tanaka et al. | 343/853 |
| 6,608,591 | B2 * | 8/2003 | Wastberg | 342/373 |
| 6,922,169 | B2 * | 7/2005 | Moh'd Izzat et al. | 342/360 |
| 7,019,710 | B1 * | 3/2006 | Shurvinton et al. | 343/853 |
| 2001/0036843 | A1 * | 11/2001 | Thompson | 455/562 |

* cited by examiner

*Primary Examiner*—Thuy V. Tran
*Assistant Examiner*—Dieu Hien T Duong
(74) *Attorney, Agent, or Firm*—Michaelson & Associates; Peter L. Michaelson

(57) ABSTRACT

Antenna systems, in particular but not exclusively, for use in base transceiver stations of wireless telecommunication networks. Specifically, the present invention combines two or more wide-beam antennas to generate relatively narrow beams and can be used in any sectorized wireless network such as, but not limited to, GSM, CDMA, TDMA and UMTS. Illustratively, two electrically separated beams, creating two electrically separated sectors, can be formed with both beams having characteristics of a combined antenna but advantageously generated using only half the number of separate antennas than conventionally taught to achieve the same beam width for each sector.

5 Claims, 5 Drawing Sheets

ANTENNA SYSTEM FOR GENERATING AND UTILIZING SEVERAL SMALL BEAMS FROM SEVERAL WIDE-BEAM ANTENNAS

CLAIM TO PRIORITY

This application claims the benefit of U.S. provisional patent application entitled "Method and System for Generating and Utilizing Several Small Beams from Several Wide-Beam Antennas", filed Jul. 16, 2003 and assigned Ser. No. 60/487,631, which is incorporated by reference herein.

FIELD OF THE INVENTION

The present invention relates to antenna systems and in particular but not exclusively to antenna systems for use in base transceiver stations of wireless telecommunication networks.

BACKGROUND OF THE INVENTION

It is known that diversity can be used to increase the signal level from a mobile phone to a base station (uplink). Diversity is applied on the reception side of the base station. A transmitted signal extremely rarely reaches the user via the most direct route. The received signal is very often a combination of direct and reflected electromagnetic waves. The reflected waves have differing phase and polarization characteristics. As a result, there can be an amplification or, in extreme cases, cancellation of the signal at specific locations. Operation in a canyon-like street, e.g., is often only possible by using reflections. These reflections from buildings, masts or trees are common, because mobile communications predominantly uses vertical polarization.

A space diversity system is known to consist of two reception antennas spaced a distance apart. One antenna has a certain field strength profile with maximums and minimums from its coverage area; the other antenna has a different field strength profile although only spaced a few meters away. Ideally, the minimum of one antenna will be completely compensated by the maximum of the other. The improvement in the average signal level achieved with this method is called diversity-gain. Both antennas function separately on different reception paths, whereby the higher signal per channel and antenna is chosen by the base station. Separation in the horizontal plane is often used (horizontal diversity). The results of vertical diversity are known to be worse.

A typical GSM Omni-base Station is made up of 3 antennas: one transmitting antenna (Tx) and two receiving antennas (Rx). The transmitting antenna is usually mounted higher and in the middle of the two receiving antennas in order to guarantee a cleaner omni-directional characteristic. Furthermore, the influence of the Rx and Tx antennas on each other is reduced (higher isolation). The two receiving antennas are usually spaced at 12-20 lambda to achieve a diversity gain of 4-6 dB.

Omni-base stations are mainly installed in regions with a relatively low number of subscribers. For capacity reasons, the communications cell is divided into 3 sectors of 120° in urban areas. Directional antennas, for example panels, are used to cover these sectors. All 3 antennas per sector can be mounted at the same height because directional antennas have higher isolation in comparison to omni-directional antennas.

The reflections which take place within urban areas are not all of the same polarization, i.e. horizontal components also exist. Furthermore, a mobile telephone is never held exactly upright which means that all polarizations between vertical and horizontal are possible. Therefore, known systems also use these signals. Space diversity uses 2 vertically polarized antennas as reception antennas and compares the signal level. Polarization diversity uses 2 orthogonally polarized antennas and compares the resulting signals. The dipoles of both antenna systems are horizontally and vertically polarized, respectively. A spatial separation is not necessary which often results in the differently polarized dipoles being mounted in a common housing. As a result, in known systems, 2 antennas can be sufficient per sector: 1×hor./vert. for polarization diversity, 1×vert. for Tx. If, in addition, the vertical path of the dual polarized antenna is fed via a duplexer for Rx and Tx, then only one antenna is needed per sector. As a result, all 3 sectors can be supplied from one mast. The diversity gain in urban areas is the same as that achieved via space diversity (4-6 dB).

It is also possible to use dipoles at +45°/−45° instead of horizontally and vertically (0°/90°) placed. It is known that this creates the possibility of two identical systems being able to handle both horizontally and vertically polarized components. Two transmitting channels using hor/ver antennas can be combined via a 3-dB-coupler onto the vertical path. As a result, half the power of both transmitting channels will be lost. Both polarizations are known to be suitable for Tx if cross-polarized antennas are used.

In mobile networks, it is common to use antennas that create sector-shaped beams. To build a smaller sector, i.e. creating a smaller beam width, two antennas can be connected to achieve half the beam width. Conventionally, if two of such small sectors are necessary, the two antennas have to be connected for each sector, i.e. two times, thus quadrupling the total antenna space.

German patent application DE10116964 discloses an antenna structure for polarization diversity reception with four antennas fitting together in a dimensional perspective with different polarization/orientation.

U.S. Pat. No. 6,583,763 discloses an antenna structure and installation. A distributed antenna array includes a plurality of antenna elements and a plurality of power amplifiers, each power amplifier being operatively coupled with one of the antenna elements and mounted closely adjacent to the associated antenna element, such that no appreciable power loss occurs between the power amplifier and the associated antenna element.

U.S. Pat. No. 3,979,754 discloses a radio frequency array antenna employing stacked parallel plate lenses. A radio frequency multi-beam array antenna is disclosed wherein a beam-forming network includes a first set of vertically disposed parallel plate lenses coupled between a matrix of radiating elements and a second set of horizontally disposed parallel plate lenses. With such a beam forming network, a plurality of narrow pencil-shaped beams of radiation may be formed over a relatively large solid angle.

US patent application US2004/0014502 discloses an antenna system for a transmitter comprising an array of antennas and control means. The antennas are arranged to transmit over all or part of the coverage area of the transmitters. The control means control the number of antennas that are used to transmit a signal in dependence on the width of the signal to be transmitted.

U.S. Pat. No. 6,195,063 discloses a dual-polarized antenna system. A dual-polarized antenna system is provided for transmitting or receiving electromagnetic waves. The antenna system has at least one cruciform radiating element module that is aligned using dipoles or in the form of a patch radiating element, at angles of +45° and −45° with respect to vertical. The antenna system further has a conductive reflector arranged in the back of the at least one radiating element module. Two conductive sidewall sections are provided on each side of the at least one radiating element and are disposed vertically. At least one slot is provided in each sidewall section at the level of the radiating element module and extends in parallel to the reflector plane.

Problem Definition

The prior art fails to disclose a solution for generating and utilizing several small beams from several wide-beam antennas without having to double the amount of antennas per beam.

Aim of the Invention

The aim of the invention is to generate and utilize several small beams from several wide-beam antennas, using only a fraction of the antenna space as conventionally needed.

SUMMARY OF THE INVENTION

The present invention provides a solution for generating and utilizing several small beams from several wide-beam antennas, using only a fraction of the antenna space as conventionally needed.

Hereto, the present invention provides an antenna system for simultaneously generating two beams. The antenna system comprises two antennas coupled via a coupler, wherein the antennas are arranged to generate electrically separated beams with the characteristics of the combined antenna. This has the advantage that half the amount of antennas is needed compared to prior art antenna systems. A different phase can be applied per antenna and the antennas can be arranged to shift the generated beams to cover one area. The antennas can be arranged to generate non-overlapping beams. E.g., the antennas can be arranged to generate a first beam shifted-45° and a second beam shifted +45°. By doing so, the antenna system effectively generates a 90° beam-width with the advantage that a 3 dB higher gain is achieved.

The present invention also provides a cylindrical antenna system. The cylindrical antenna system comprises at least three antenna systems introduced above, in which the antennas are cylindrically lined-up. The cylindrical antenna system thus comprises at least six antennas. This has the advantage that small beams can be used with high gains, with the cylindrical antenna system effectively having a beam-width of 360°.

The present invention provides a coupler for use in the antenna system according to the invention. The coupler enables the antennas to operate in different phases. The coupler can comprise a first hybrid coupler connected to a fourth hybrid coupler and connected to a first phase shifter. The first hybrid coupler can be connectable to the first antenna. A second hybrid coupler can be connected to a third hybrid coupler and can be connected to a second phase shifter. The second hybrid coupler can be connectable to the second antenna. The third hybrid coupler can also be connected to the first phase shifter. The fourth hybrid coupler can also be connected to the second phase shifter.

A first receiver pre-amplifier can be connected to the first hybrid coupler and the first antenna can be connected to the first receiver pre-amplifier. This has the advantage that power loss from the first antenna can be compensated. A second receiver pre-amplifier can be connected to the second hybrid coupler and the second antenna can be connected to the second receiver pre-amplifier. This has the advantage that power loss from the second antenna can be compensated.

DETAILED DESCRIPTION OF THE INVENTION

For the purpose of teaching of the invention, preferred embodiments of the method and system of the invention are described in the sequel. It will be apparent to the person skilled in the art that other alternative and equivalent embodiments of the invention can be conceived and reduced to practice without departing from the true spirit of the invention, the scope of the invention being limited only by the appended claims as finally granted.

The invention combines two or more wide-beam antennas to generate smaller beams and can be used in any sectorized wireless network such as, but not limited to, GSM, CDMA, TDMA, and UMTS. In the simplest case, from a double antenna system two electrically separated beams, creating two electrically separated sectors, can be formed, both beams having the characteristics of the combined antenna.

Figure 1:
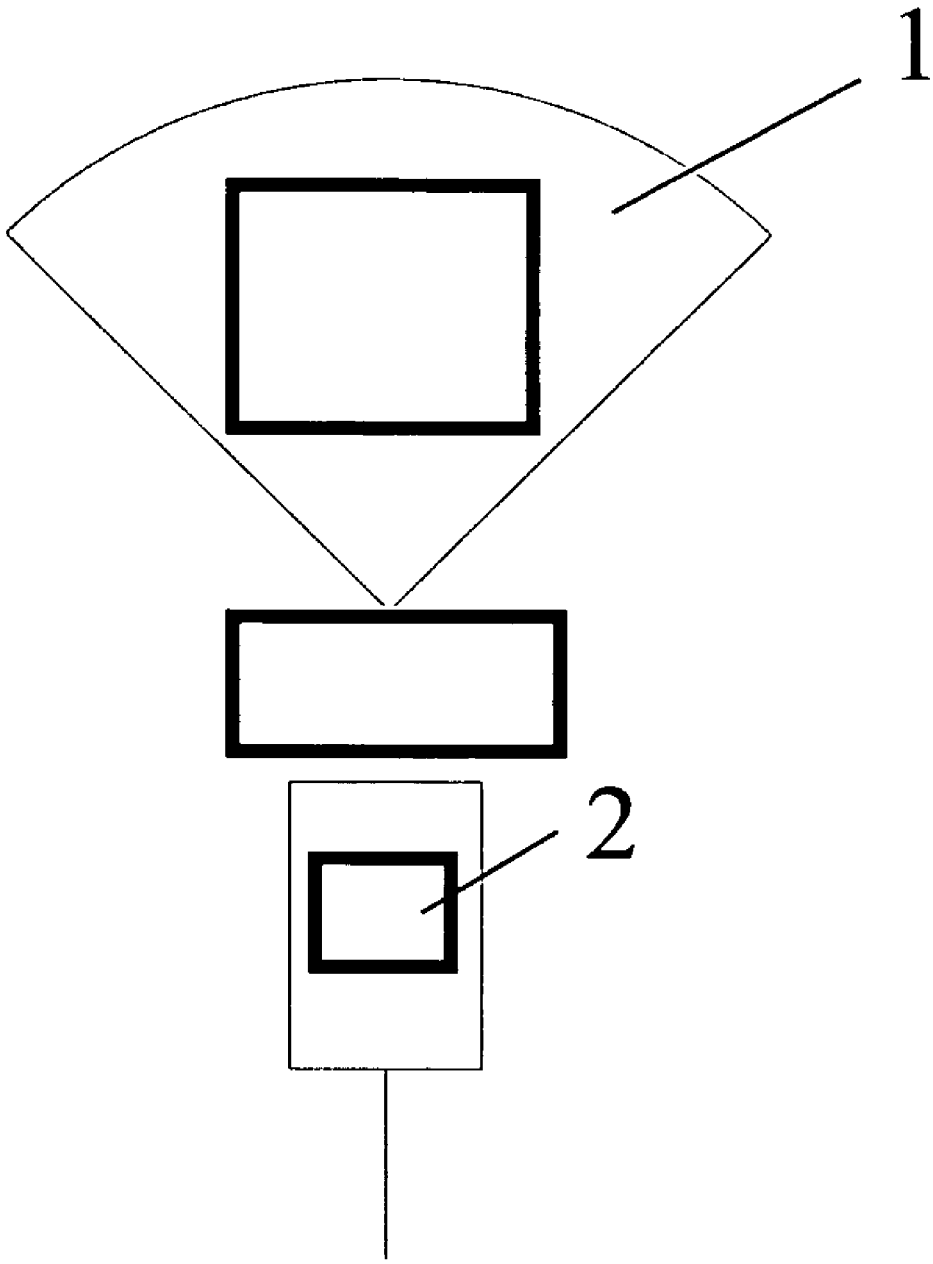
FIG. 1 represents a prior art antenna system.

In FIG. 1 a prior art antenna system is shown. The vertically (90°) placed antenna (2) creates a beam (1) with a beam-width of 90°.

Figure 2:
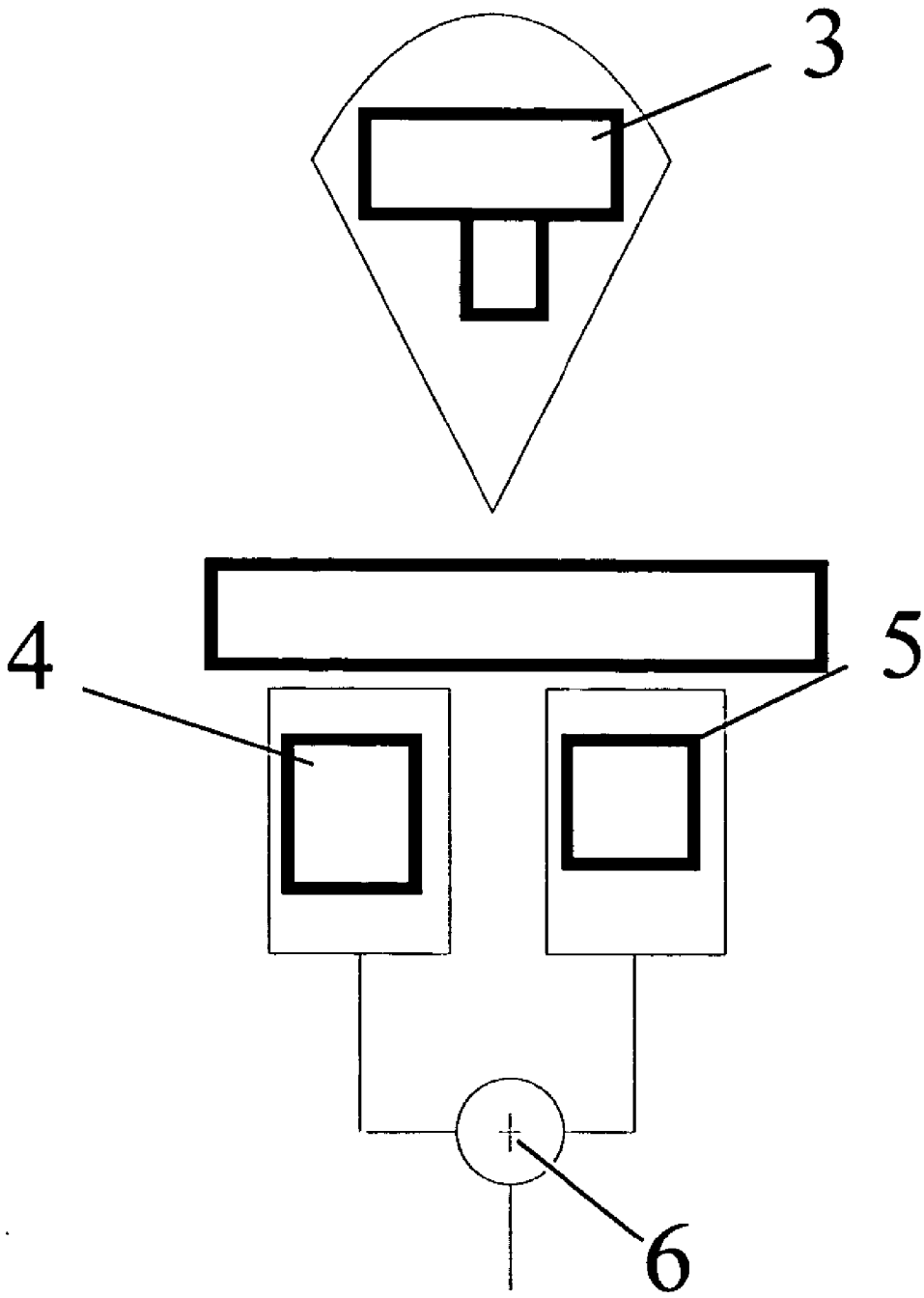
FIG. 2 represents another prior art antenna system.

To create a smaller beam-width two antennas operating in phase can be coupled as shown in the prior art antenna system of FIG. 2. Two vertically (90°) placed sector antennas (4,5) operating in phase are coupled, via a coupler (6), to create a beam (3) with half the original beam-width, i.e. a beam-width of 45°. By doing so, the gain is increased by 3 dB, but the antenna system is two times larger compared to the antenna system of FIG. 1.

If two beams with a beam-width of 45° are required, four antennas are needed according to the prior art.

The invention uses only two antennas to form two small beams (i.e. two small sectors) at the same time. The antennas are connected by passive electronic elements, like couplers and cables. The advantage is that 2 antennas are saved, while the same effect is achieved.

Figure 3:
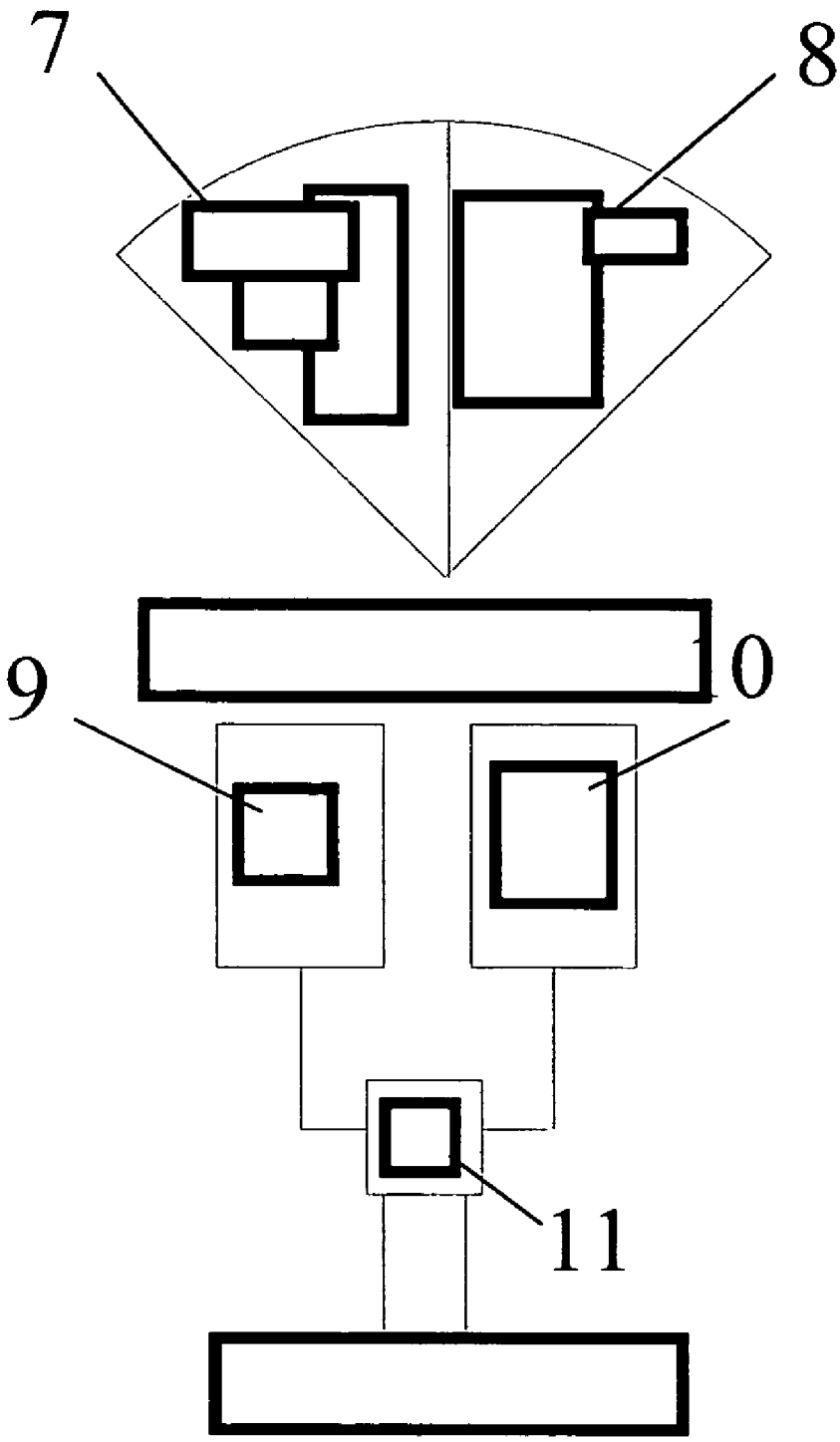
FIG. 3 shows an example of an antenna system according to the present invention.

In FIG. 3 an example of an antenna system according to the present invention is shown. Two beams (7,8), each with a beam-width of 45°, are created using two sector antennas (9,10). The two sector antennas can be placed in any direction. It is, e.g., possible to place the antennas at +45° or at −45° or horizontally at 0° or vertically at 90°. In this example, the two antennas are placed horizontally. By applying a different phase per antenna, the first beam (7) is shifted −45° and the second beam (8) is shifted +45°. The coupler (11) enabling this is shown in more detail in FIG. 4.

Figure 4:
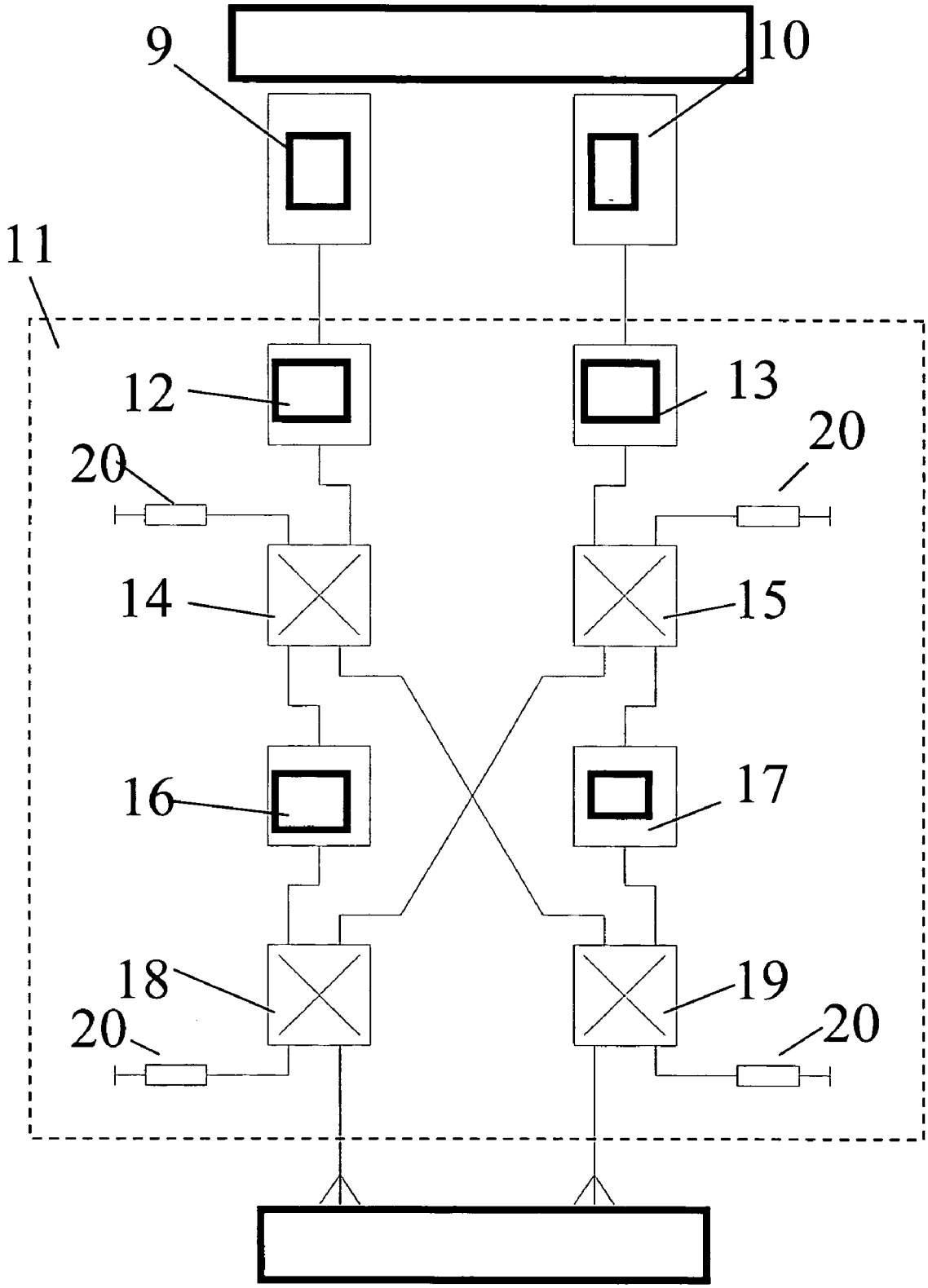
FIG. 4 shows an example of a coupler used in an antenna system according to the present invention.

In FIG. 4 two sector antennas (9,10) are coupled via coupler (11). A different phase is applied per antenna. To achieve this, the first antenna (9) is coupled to the first receiver pre-amplifier (12) and the second antenna (10) is coupled to the second receiver pre-amplifier (13). The hybrid couplers (14,15,18,19) and the phase shifters (16,17) create the different phases in which the antennas are operating. In case the antennas are receiving signals, half the signaling power is consumed by the resistors (20). The receiver pre-amplifiers (12,13) compensate the power loss.

In case the antennas are transmitting signals, also half the signaling power is consumed by the resistors (20). This can be compensated by increasing the transmitting power by using X-Pol antennas or using air-combining.

Figure 5:
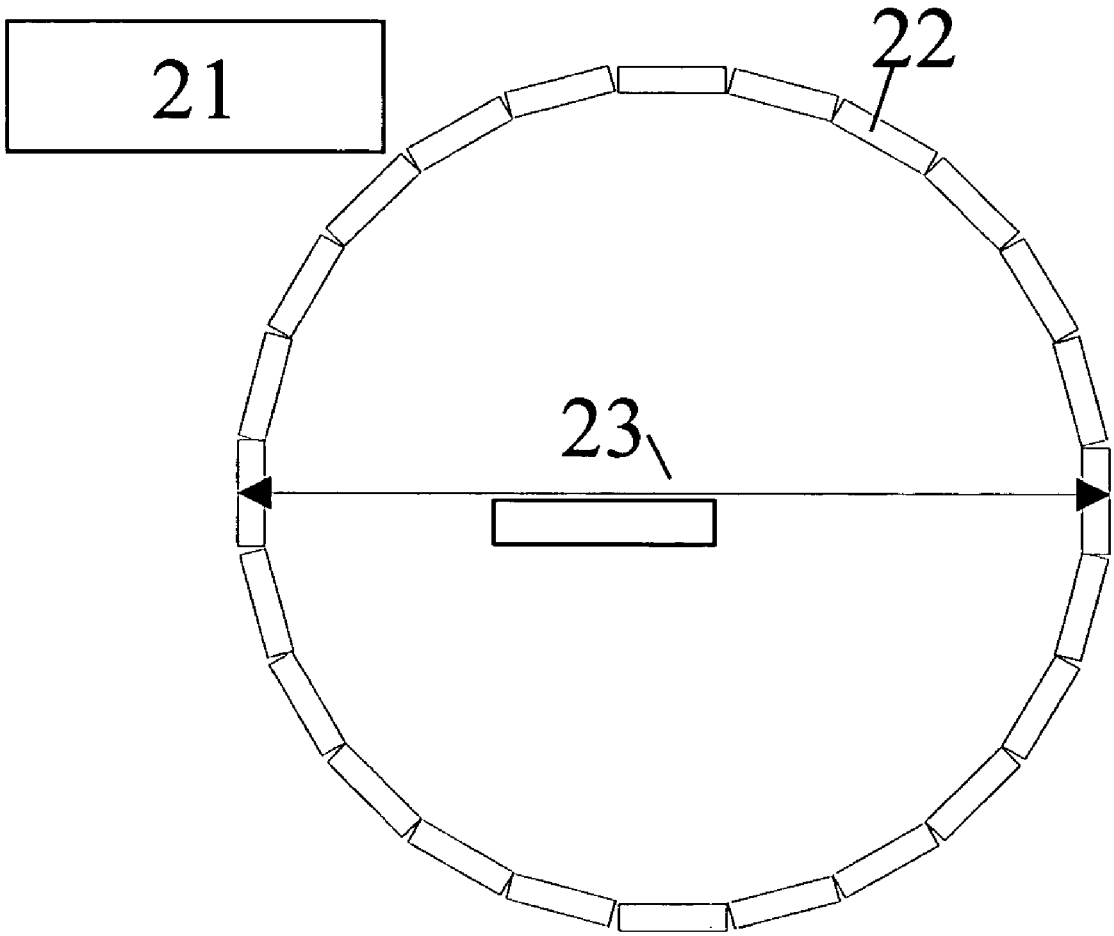
FIG. 5 shows another example of an antenna system according to the present invention.

The invention makes it possible to build larger antenna systems to save more antennas and build very small sectors. Combining six or more antennas in, e.g., a cylindrical line-up can result in small beams forming sectors with coverage of up to an angle of 360°. In FIG. 5, an example antenna system (21) is shown from above that can cover an angle of 360°. This antenna system comprises antennas (22) that are placed in a circle with a diameter (23). E.g., 36 sectors can be created using the invention, each sector being covered by an antenna creating a beam with a beam-width of 10°.

The invention claimed is:

1. Antenna system for simultaneously generating two beams, wherein the antenna system consists of first and second antennas coupled via a coupler and the antennas are arranged to generate electrically separated beams with the characteristics of a combined antenna, the coupler comprising:

a first hybrid coupler connected to both a fourth hybrid coupler and a first phase shifter, the first hybrid coupler being connectable to the first antenna;

a second hybrid coupler connected to both a third hybrid coupler and a second phase shifter, the second hybrid coupler being connectable to the second antenna;

the third hybrid coupler also connected to the first phase shifter;

the fourth hybrid coupler also connected to the second phase shifter;

wherein a different phase is applied per antenna and the antennas are arranged to shift the generated beams to cover different areas;

wherein the antennas are arranged to generate a first beam shifted about −45° and a second beam shifted about +45°; and wherein the antennas are arranged to generate non-overlapping beams.

2. A cylindrical antenna system comprising at least three antenna systems according to claim 1, in which the at least three antennas are cylindrically oriented.

3. The coupler for use in the antenna system according to claim 1, in which the coupler enables the antennas to operate in different phases.

4. The coupler according to claim 3, further comprising:

a first receiver pre-amplifier connected to the first hybrid coupler and the first antenna being connectable to the first receiver pre-amplifier;

a second receiver pre-amplifier connected to the second hybrid coupler and the second antenna being connectable to the second receiver pre-amplifier.

5. Antenna system for simultaneously generating two beams, wherein the antenna system consists of first and second antennas coupled via a coupler and the antennas are arranged to generate electrically separated beams with the characteristics of a combined antenna, the coupler comprising:

a first hybrid coupler connected to both a fourth hybrid coupler and to a first phase shifter, the first hybrid coupler being connectable to the first antenna;

a second hybrid coupler connected both to a third hybrid coupler and a second phase shifter, the second hybrid coupler being connectable to the second antenna;

the third hybrid coupler also connected to the first phase shifter;

the fourth hybrid coupler also connected to the second phase shifter;

a first receiver pre-amplifier is connected to the first hybrid coupler and only the first antenna being connectable to the first receiver pre-amplifier;

a second receiver pre-amplifier is connected to the second hybrid coupler and only the second antenna being connectable to the second receiver pre-amplifier;

wherein a different phase is applied per antenna and the antennas are arranged to shift the generated beams to cover different areas;

wherein the antennas are arranged to generate a first beam shifted about −45° and a second beam shifted about +45°;

wherein the antennas are arranged to generate non-overlapping beams; and wherein the antenna system includes at least three pairs of first and second antennas, and the at least three pairs of antennas are cylindrically oriented.

* * * * *